US005229689A

United States Patent [19]

Forsblad et al.

[11] Patent Number: 5,229,689

[45] Date of Patent: Jul. 20, 1993

[54] ELECTROSTATIC SHIELD FOR NEARFIELD ALTERNATING ELECTRICAL FIELD EMISSION REDUCTION IN A CRT DISPLAY

[75] Inventors: Larry Forsblad; Roy Askeland, both of Los Altos; David Auld, San Jose, all of Calif.

[73] Assignee: Apple Computer, Inc., Cupertino, Calif.

[21] Appl. No.: 699,824

[22] Filed: May 14, 1991

[51] Int. Cl.[5] ..... H01J 1/52

[52] U.S. Cl. ..... 315/85; 315/8

[58] Field of Search ..... 315/8, 85; 313/447, 313/449, 402, 240, 242, 313; 250/519.1

[56] References Cited

U.S. PATENT DOCUMENTS

| | | | |
|---|---|---|---|
| 3,443,138 | 5/1969 | Schwartz | 315/8 |
| 3,728,573 | 4/1973 | Roeber | 313/242 |
| 3,867,668 | 2/1975 | Shrader | 313/313 |
| 4,274,031 | 6/1981 | Saito | 315/8 |
| 4,392,083 | 7/1983 | Costello | 315/8 |
| 4,767,969 | 8/1988 | Green | 315/8 |
| 4,864,192 | 9/1989 | Buchwald | 315/8 |
| 4,940,920 | 7/1990 | Giannantonio | 315/8 |

FOREIGN PATENT DOCUMENTS

| | | | |
|---|---|---|---|
| 0058488 | 4/1982 | Japan | 315/8 |

*Primary Examiner*—Eugene R. LaRoche
*Assistant Examiner*—A. Zarabian
*Attorney, Agent, or Firm*—Stuart J. Madsen

[57] ABSTRACT

An electrostatic shield and method for shielding an electric field are presented, having particular application to the reduction of electric field emissions from a CRT display. The electrostatic shield is formed from a flexible non-conductive substrate and includes a plurality of radially disposed conductive elements. The shield is secured to the outer surface of the CRT, between the deflection yoke and screen, and the conductive elements are coupled to ground potential. In addition to a method for using the abovedescribed shield, a method is presented for shielding the electric field by applying conductive traces directly to the surface of the CRT, again between the deflection yoke and screen. These traces are coupled to the aquadag coating on the outer surface of the CRT, effectively grounding the traces and providing the desired shielding effect.

6 Claims, 7 Drawing Sheets

ELECTROSTATIC SHIELD FOR NEARFIELD ALTERNATING ELECTRICAL FIELD EMISSION REDUCTION IN A CRT DISPLAY

BACKGROUND OF THE INVENTION

1. Field of the Invention

The present invention relates generally to apparatus and methods for reducing electrical field emissions, and more specifically to an electrostatic shield and method for reducing nearfield alternating electrical field emissions in a CRT display.

2. Brief History of the Art

Cathode ray tube (CRT) displays are used in conjunction with a wide variety of electrical systems, and are most commonly associated with ordinary television sets and computer monitors. These displays normally employ a deflection yoke for controlling an electron beam which produces a visible image on the CRT screen. The deflection yoke generates a complex alternating electromagnetic field, a portion of which emanates towards and through the screen, eventually reaching the device operator. This electromagnetic field includes an AC magnetic component, used to control the deflection angle of the electron beam, and an AC electric component.

During the past several years major concerns have been raised by various groups regarding potential health hazards inherent in devices which generate electromagnetic fields. Although there are presently no U.S. government regulatory standards defining harmful versus non-harmful levels of electromagnetic field exposure, several international communities have discussed potential guidelines. Increased public awareness of these potential hazards has also surfaced, and has led to increasing numbers of products designed to limit the amount of electromagnetic field exposure an operator experiences while using a particular device.

Illustrative of such a design, computer monitors normally include metal shielding which substantially covers the monitor chassis. It is a well known physical principle that the field lines of an AC electric field will terminate on any surface which has a zero or near zero potential with reference to the AC source. Thus, the grounded metal shielding covering the monitor chassis effectively terminates the AC electric field inside the chassis wherever the shielding is placed. Although this reduces the resultant AC electric field on the outside of the monitor wherever the shielding is placed, metal shielding of the magnitude used to cover the chassis cannot be placed in front of the CRT screen without seriously degrading monitor performance. Unfortunately, this is precisely the direction of AC electric field line propagation which affects an operator the most.

Existing countermeasures for reducing the frontally directed AC electric field include placing a conductive screen or thin metal film over the CRT face. The screen or film must then be electrically connected to chassis ground. Although these countermeasures help in reducing overall field emissions, there are several serious inherent problems which limit their effectiveness. These problems include degradation of front of screen CRT performance, mechanical form and fit problems and high associated design and production costs. Especially in today's competitive display market, screen performance in a CRT and overall product cost are not features to be compromised. Thus, existing solutions to the AC electric field emission problems are inadequate.

As will be discussed in detail below, the present invention provides an improved electrostatic shield and method for reducing alternating electric field emissions in a CRT display. Because the shield is implemented in the display in non-interfering relationship to the electron beam of the CRT, the present invention provides excellent reduction in the AC electric field emission through the CRT screen, while producing no front of screen performance degradation.

SUMMARY OF THE INVENTION

An electrostatic shield in accordance with one embodiment of the present invention comprises a non-conductive base member which supports a plurality of radially disposed, equispaced conductive elements. A common connecting means electrically couples these conductive elements together and to circuit ground. The base member is formed from a thin, flexible material, which enables the shield to conform to the outer surface of a CRT. A plurality of incisions are made at various positions on the base member to further enhance proper conformity of the shield to the CRT surface.

In a normal mode of operation, the shield is positioned on the outer surface of the CRT between the deflection yoke and the CRT screen. In this configuration, the frontally directed electrical component of the electromagnetic field generated by the deflection yoke and associated CRT circuitry is intercepted by the grounded electrostatic shield and effectively shielded from the face of the CRT. Since the electrostatic shield is disposed such that it completely surrounds the electron beam generated by the CRT, it does not interfere with the beam, and overall screen performance is not affected. Additionally, because the shield can be fully manufactured while the base member is substantially flat, it is easier to produce with a high degree of precision and cost effectiveness.

IN THE DRAWINGS

Figure 8A:
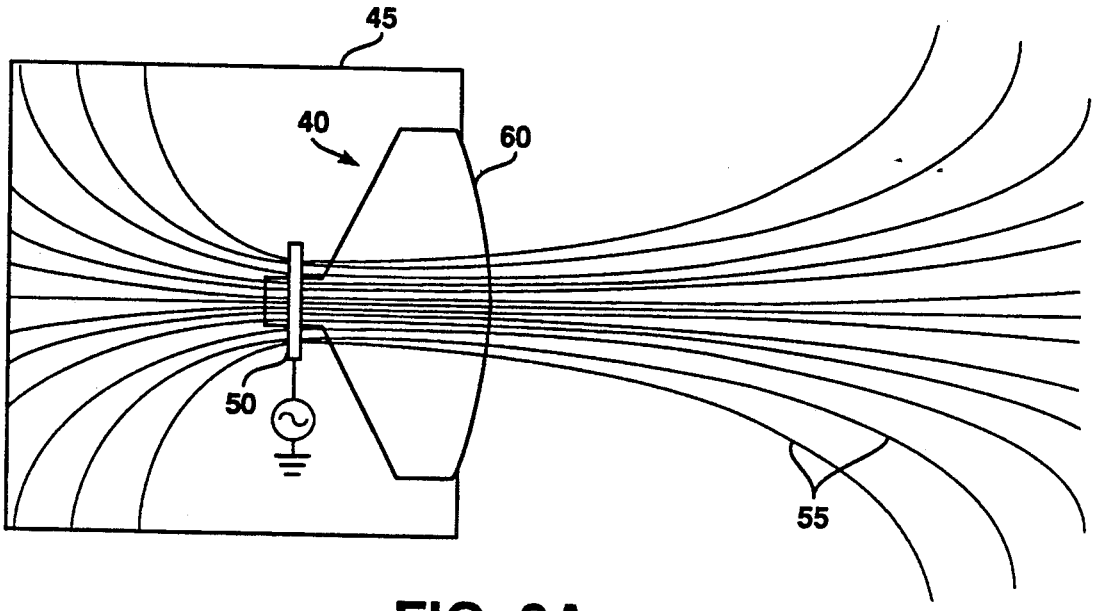
FIG. 8A Prior Art

FIG. 8*a* is a cross-sectional view of a CRT illustrating the electric field potential lines generated through the face of the CRT.

Figure 8B:
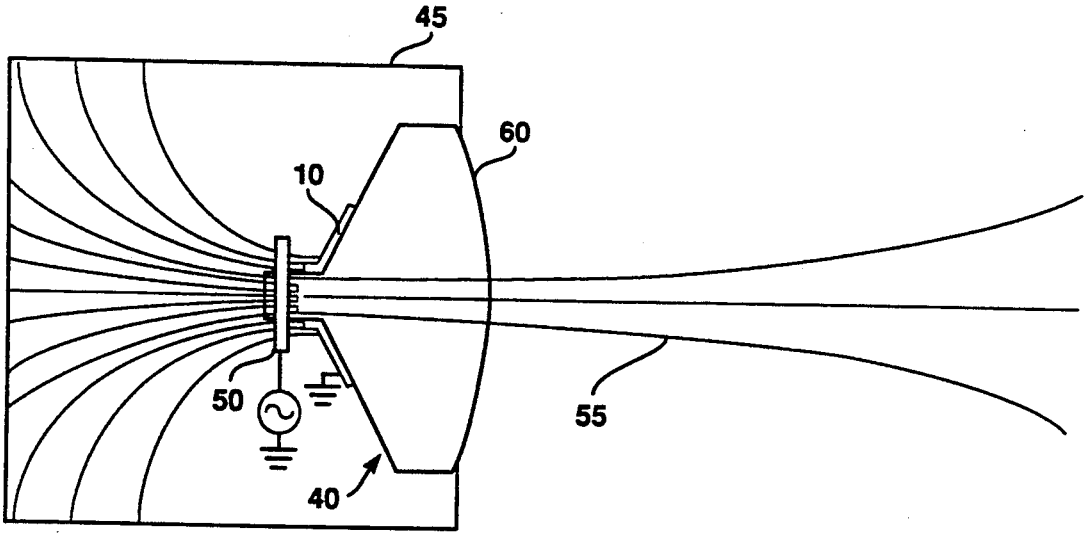

FIG. 8*b* is a cross-sectional view of the CRT of the FIG. 8*a* including an electrostatic shield in accordance with the present invention, illustrating the resultant diminished electric field potential lines generated through the face of the CRT.

DETAILED DESCRIPTION OF THE PREFERRED EMBODIMENT

An electrostatic shield and a method for shielding an electric field are disclosed having particular application for use in conjunction with a computer monitor or similar CRT-based device. In the following description, for purposes of explanation, specific numbers, materials and configurations are set forth in order to provide a thorough understanding of the present invention. However, it will be apparent to one skilled in the art that the present invention may be practiced without reference to the specific details. In other instances, well known systems are shown in diagrammatical or block diagram form in order not to obsure the present invention unnecessarily.

Figure 1:
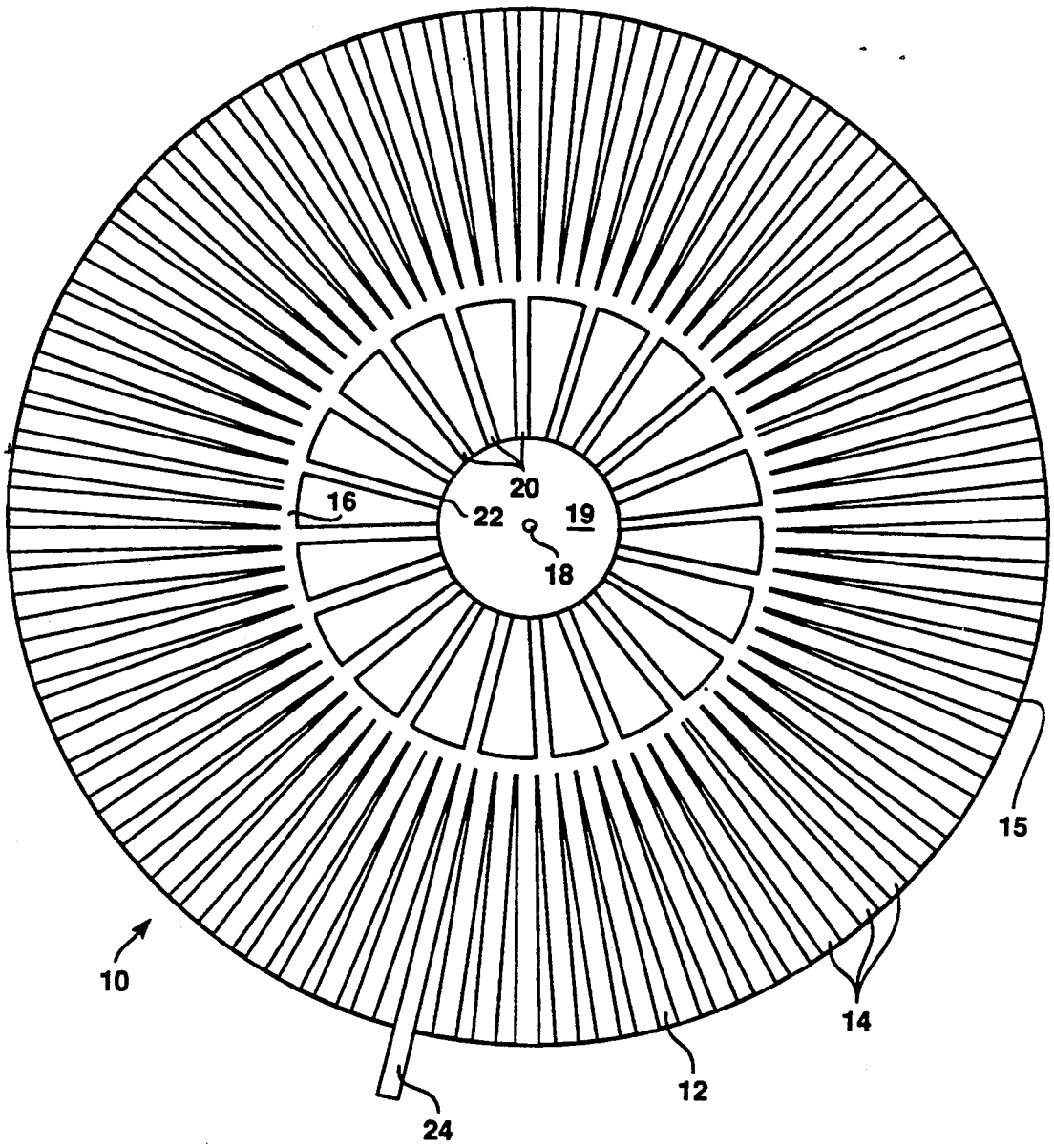
FIG. 1 is a top plan view of an electrostatic shield in accordance with the present invention, illustrating a shield as it appears before it is cut to fit the external surface of a CRT.

Referring now to FIG. 1, shown is a top plan view of a electrostatic shield 10 in accordance with the present invention as it appears in its planar state, before it has been modified to conform to the outer surface of a CRT (as described in detail below). A flexible non-conductive substrate forms a substantially planar base 12 of electrostatic shield 10. A plurality of outer conductive elements 14 are radially disposed on base 12 and extend from a central connecting means 16 to an outer perimeter 15 of the base. Connecting means 16 shares a common central axis 18 with base 12, and conductively couples each of the outer elements 14 together. A plurality of inner conductive elements 20 are radially disposed on base 12 and extend from an inner perimeter 22 of the base to central connecting means 16. Central connecting means 16 electrically couples each of the inner conductive elements 20 together and to outer conductive elements 14. In this embodiment, a single elongated ground tab 24 is electrically coupled to connecting means 16, and extends a predetermined distance beyond outer perimeter 15 of base 12. In operation, ground tab 24 is used to couple connecting means 16, and therefore inner conductive elements 20 and outer conductive elements 14, to circuit ground.

Although an electrostatic shield of substantially uniformly distributed conductive material is operable to shield the electric field generated by the deflection yoke from the face of the CRT, there are associated problems which make implementation of a shield in this form untenable. Magnetic fields created by the deflection yoke induce large currents in a continuous metal shield which cause the metal to heat up rapidly, and which, consequently, increase deflection current significantly. The heating process eventually causes deterioration of the metal, and causes functional breakdown of the shield. The magnitude of the large currents, technically known as eddy currents, is proportional to the length of the path on which the currents are able to travel. An electrostatic shield 10 constructed in accordance with the present invention obviates the eddy current loss problems by keeping the conductive elements 14 and 20 small, thus minimizing the available current paths.

Although it is contemplated that any flexible non-conductive material could be utilized in forming base 12, a preferred embodiment of the electrostatic shield employs a base formed from a polyemide substrate. Base 12 has a thickness of approximately 1 to 5 mm, however, any thickness which preserves the flexibility characteristics of the electrostatic shield would be appropriate. Outer conductive elements 14, inner conductive elements 20, and connecting means 16 are all formed from a material or materials which exhibit the appropriate conductive characteristics of the electrostatic shield. In the preferred embodiment, a copper laminate is applied to base 12 to an approximate thickness of between 0.7 and 2.8 mm, with 1.4 mm being the preferred thickness. The laminate is then etched to form conductive elements 12 and 20, ground tab 24, and connecting means 16.

Figure 2:
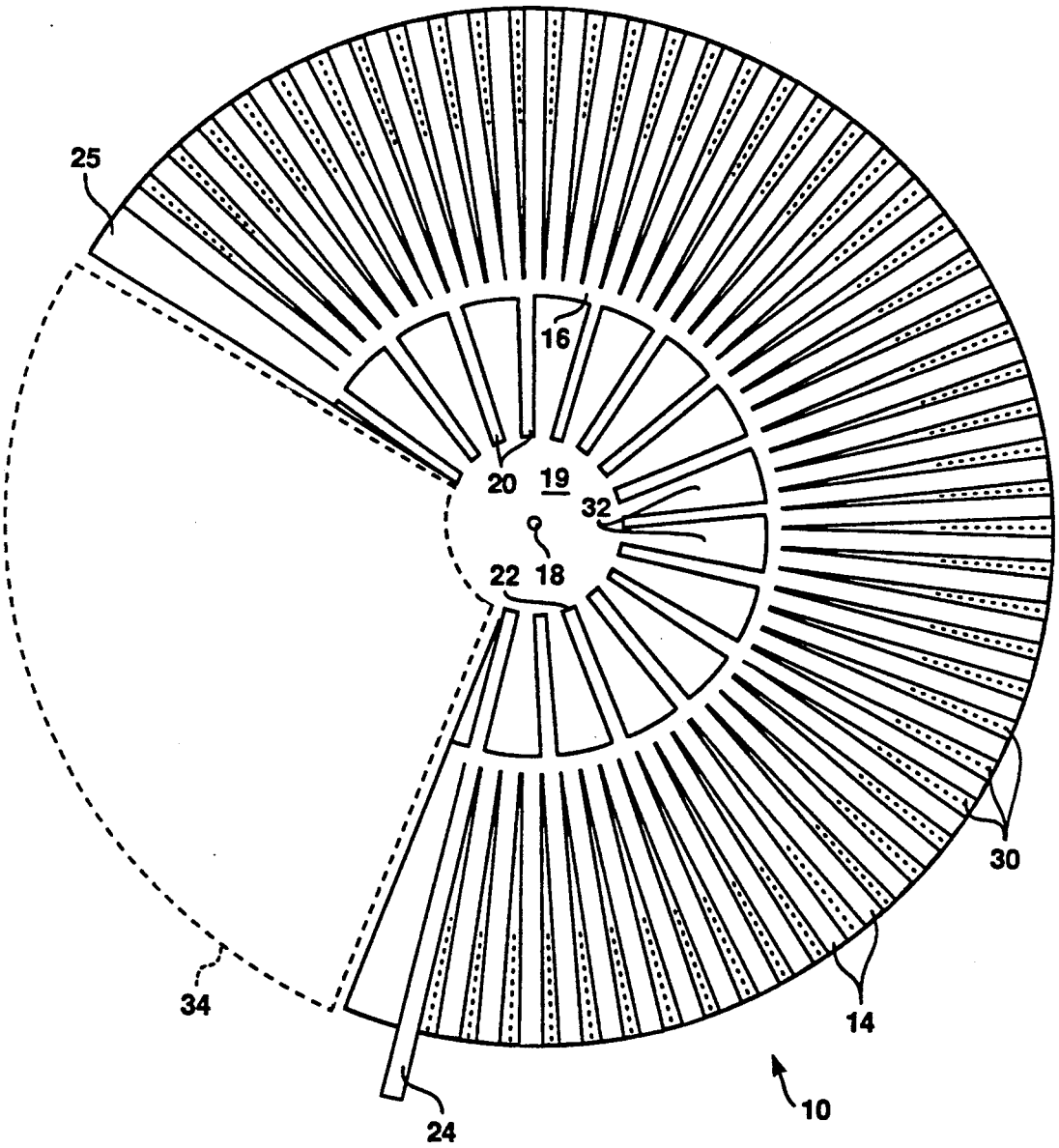
FIG. 2 is a top plan view of an electrostatic shield in accordance with the present invention, illustrating a removed sector (shown in phantom) and cutting line demarcations.
Figure 6:
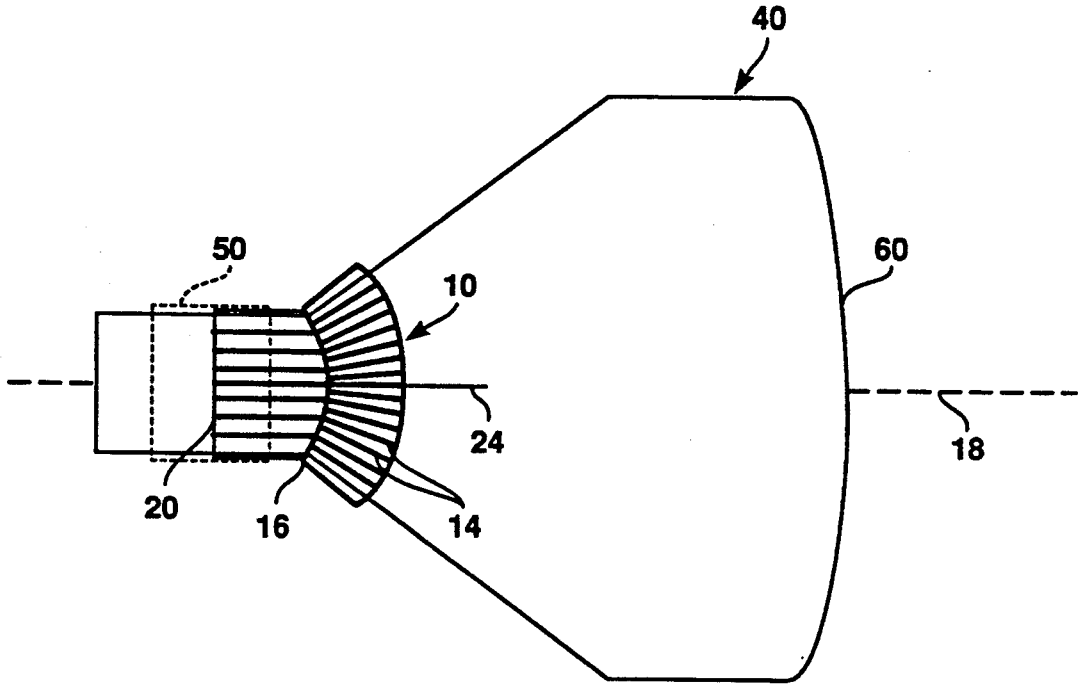
FIG. 6 is an elevational view illustrating the interrelationship between an electrostatic shield in accordance with the present invention and a CRT.

In its operational environment, electrostatic shield 10 is placed over the outer surface of a CRT (as shown in FIG. 6). To facilitate an appropriate fit between the electrostatic shield and the CRT, various portions of shield 10 are cut in a manner which enables the shield to better assume the surface configuration of the CRT. Referring now to FIG. 2, shown is a top plan view of an electrostatic shield 10 constructed in accordance with the present invention. An aperture 19 is formed through the center of shield 10, and is bounded by inner perimeter 22. Interstitial demarcation lines 30, between outer conductive elements 14, represent exemplary positions at which incisions are made in shield 10. That is, shield 10 is cut between outer conductive elements 14 along the length of the dotted demarcation lines 30. This enables an outer portion of each of the conductive elements 14 to be physically disconnected from each juxtaposed conductive element, and allows each of these outer portions to move independently of the others.

Inner conductive elements 20 are physically separated from one another by cutting interstitial wedges 32 between adjacent conductive elements 20. Each wedge 32 is symmetric with respect to the other wedges, and begins at inner perimeter 22 extending to connecting means 16. Although described in terms of "wedges," it is important to note that any shape of incision between inner conductive elements 20 which maintains the physical separation between the elements, and facilitates appropriate conformity of the electrostatic shield to the outer surface configuration of the CRT, could be employed. Additionally, although FIG. 2 illustrates an electrostatic shield 10 which has been cut between every outer conductive element 14, alternative embodiments include a shield having incisions between every other outer conductive element, every third outer conductive element, etc. An alternative embodiment of shield 10 could also include a shield which is cut between the various outer or inner conductive elements to varying lengths. For example, the length of the incisions from the outer perimeter 15 toward connecting means 16 could vary between each or all of the elements.

A sector 34 (shown in phantom) is dissociated from electrostatic shield 10 to further facilitate appropriate conformity between the shield and a CRT. Sector 34 is removed from shield 10 by cutting from outer perimeter 15 to inner perimeter 22 at a first position along a radial line adjacent to a first outer conductive member, and at a second position along a radial line adjacent to a second outer conductive member, remote from the first conductive member. As will be described in further detail below, when the radial sides of the shield formed by removal of sector 34 are brought into contact with one another, electrostatic shield 10 assumes a shape similar to that of the outer surface of a CRT (as shown in FIG. 4). This enables the shield to be placed over the CRT in its functional position with minimal difficulty, time and expense, and maximum space efficiency. Of course, sector 34 could be cut from shield 10 in any manner and in any shape which enables the shield to conform to the outer surface configuration of a CRT when placed thereon. Additionally, shield 10 could be formed directly into a shape as illustrated in FIGS. 1–4, without subsequent alteration and sector removal, by an appropriate forming means. This is simply a choice of manufacturing convenience and economy, the important feature being a shield perimeter configuration which facilitates conformity to the CRT surface.

Figure 3:
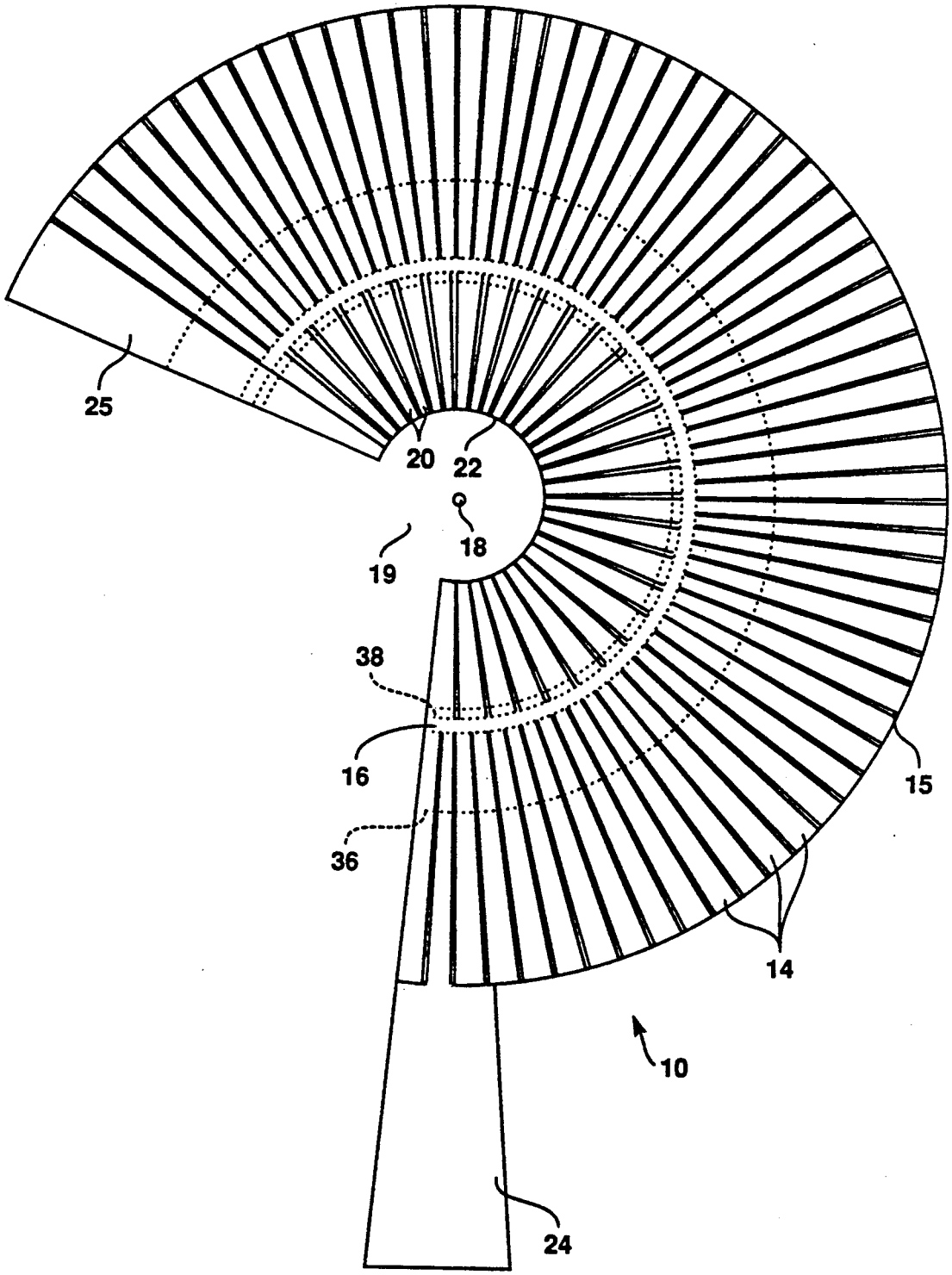
FIG. 3 is a top plan view of an alternative embodiment of an electrostatic shield in accordance with the present invention.
Figure 4:
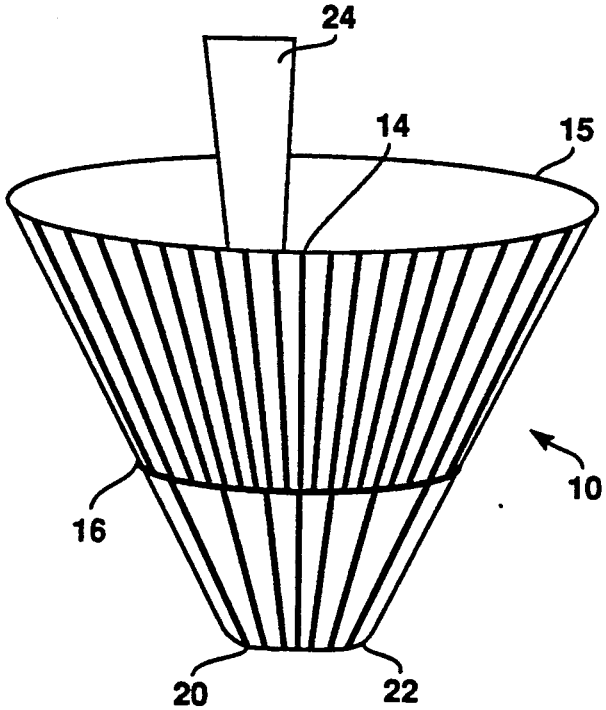
FIG. 4 is a perspective view of an electrostatic shield in accordance with the present invention, illustrating the natural shape the shield assumes after it has been prepared for implementation in the display.

Referring now to FIG. 3, shown is a top plan view of an alternative embodiment of an electrostatic shield 10 in accordance with the present invention. As is illustrated, sector 34 (shown in FIG. 2, not shown in FIG. 3) has been removed, and shield 10 remains substantially planar. Ground tab 24 has been enlarged to facilitate efficient connection to a radial connecting element 25, and to further facilitate effective coupling of shield 10 to ground potential. Additionally, in this embodiment, conductive elements 14 and 20 vary in width from outer perimeter 15 to connecting means 16, and from connecting means 16 to inner perimeter 22, respectively. Demarcation line 36 represents the distance to which incisions are made in shield 10 from outer perimeter 15 between conductive elements 14. Similarly, demarcation line 38 represents the distance to which incisions are made in shield 10 from inner perimeter 22 between conductive elements 20. Note that the "wedges" (as described in relation to FIG. 2) between conductive elements 20 have been replaced by simple incisions in the embodiment depicted in FIG. 3.

In this embodiment, the width of outer conductive elements 14 taper from approximately 5 mm at outer perimeter 15 to approximately 2.5 mm at connecting means 16. Inner conductive elements 20 taper from approximately 4.0 mm at connecting means 16 to approximately 1.5 mm at inner perimeter 22. The spacing between outer elements 14 decreases from approximately 0.621 mm at outer perimeter 15 to approximately 0.244 mm at connecting means 16. Connecting means 16 is approximately 6 mm in width, and is disposed approximately 77 mm from central axis 18. Outer perimeter 15 of electrostatic shield 10 lies approximately 170 mm from central axis 18. It should be noted that, although described in terms of specific measurements, the minimum spacing between the various conductive elements is dictated only by the necessity of preserving electrical isolation between the elements.

In the embodiment of FIG. 3, shield 10 is prepared for implementation in the display system by cutting between every third outer conductive element 14 to demarcation line 36, which lies approximately 110 mm from central axis 18. The shield is further prepared by cutting between every second inner conductive element 20 to demarcation line 38, which lies approximately 74 mm from central axis 18. The space created by the removal of sector 34 comprises a 107 degree section of electrostatic shield 10, the angle being defined by the sweep of a radial line which extends from central axis 18 to outer perimeter 15. Ground tab 24, which extends from inner perimeter 22 to a distance approximately 50 mm beyond outer perimeter 15, is coated with a conductive adhesive to facilitate connection to radial connecting element 25 when brought into contact therewith. As further described below, ground tab 24 is used to conductively couple electrostatic shield 10 to the grounded aquadag coating on the outer surface of the CRT.

Referring briefly now to FIG. 4, shown is the electrostatic shield 10 of FIG. 3 in its operational configuration. Ground tab 24 and radial connecting element 25 (not shown in FIG. 4) have been connected, and remain coupled together by conductive adhesive (described above). As is shown in FIG. 4, shield 10 assumes a non-planar shape at this time, similar to the frustum of a right circular cone. The ability of the shield to assume this shape, and the various incisions (not shown) between the conductive elements enables the shield to be placed over the outer surface of a CRT and easily conform to the CRT's shape.

Figure 5:
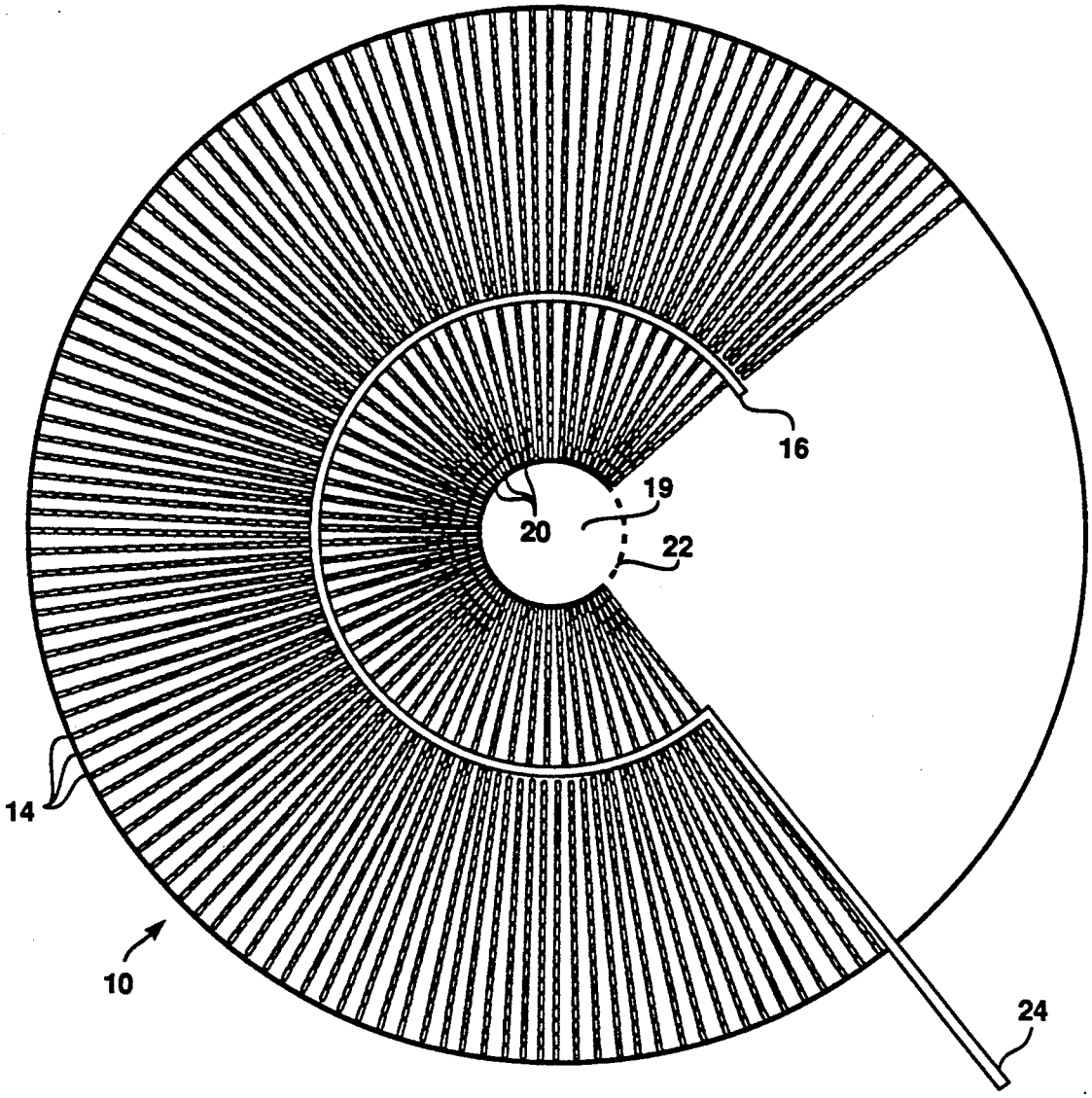
FIG. 5 is a top plan view of an alternative embodiment of an electrostatic shield in accordance with the present invention.

Referring briefly to FIG. 5, shown is a top plan view of an alternative embodiment of electrostatic shield 10 in accordance with the present invention. As depicted in the figure, the basic structure of the electrostatic shield is substantially the same as that shown in FIG. 2, however both the inner and outer radially disposed conductive members, and the annular connecting means, have a substantially diminished width. This, once again, reduces the heating effect and power draw within the members by providing a reduced current path and reduced conductive surface area.

FIG. 6 is an elevational view illustrating an electrostatic shield 10 in its operational environment. In a normal mode of operation, shield 10 is positioned over a predetermined portion of the outer surface of CRT 40, between deflection yoke 50 (shown in phantom) and a face 60 of the CRT. In this position, central axis 18 of shield 10 is substantially coaxial with the central longitudinal axis of the CRT, and connecting means 16 lies approximately in the position at which the funnel of the CRT and the neck of the CRT meet. The natural shape of the prepared shield 10 in its operational configuration, and the interstitial incisions between the outer conductive elements 14, enable the shield to splay outward to conform to the funnel portion of the CRT. Similarly, the natural shape of the prepared shield and the interstitial incisions between inner conductive elements 20 enable the shield to conform to the cylindrical neck of the CRT. Ground tab 24 is conductively coupled to the aquadag coating (not shown) on the outer surface of CRT 40, thus acting to ground each of the conductive elements of the shield. It is important to note that shield 10 can be positioned on the outer surface of CRT 40 in any appropriate manner which does not interfere with the proper function of the shield. In the preferred embodiment, shield 10 is held in place against the outer surface of CRT 10 by the deflection yoke 50.

Figure 7:
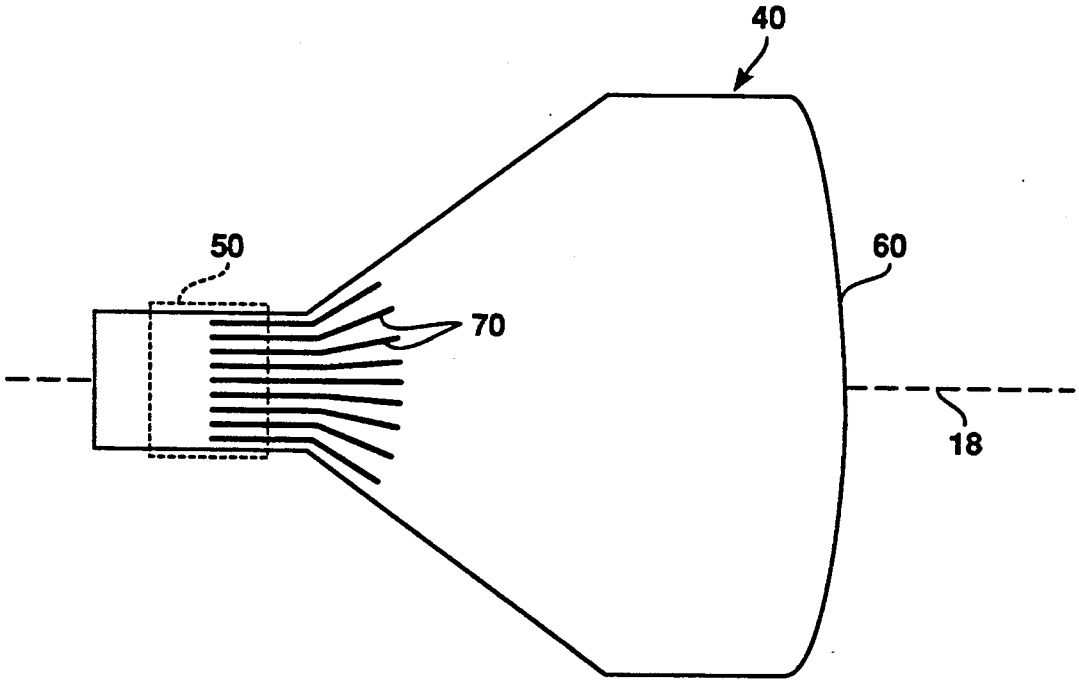
FIG. 7 is an elevational view of an alternative shield in accordance with the method of the present invention.

An alternative method of shielding the electric field generated by the deflection yoke and associated circuitry from the face of a CRT is illustrated in FIG. 7. As can be seen by comparison with the electrostatic shield of FIG. 6, substantially the same physical phenomenon is being utilized in the method as shown in FIG. 7 and by electrostatic shield 10. The method of electric field shielding in accordance with the present invention comprises applying electrically dissociated conductive traces 70 directly to the outer surface of the CRT, between the deflection yoke and CRT face 60. In a preferred configuration, these traces extend from predetermined positions on the cylindrical CRT neck a predetermined distance towards CRT face 60, parallel to central axis 18. This effectively positions the traces between the electric field generated by the deflection yoke and the CRT face. Thus, once conductive traces 70 are connected to ground potential, the electric field is effectively shielded from a user.

Traces 70 can be coupled to the surface of the CRT in any appropriate manner which preserves the electric field shielding effect. In one embodiment, traces 70 comprise conductive strips of material, such as copper, which are secured to the surface of the CRT using a conductive adhesive. Alternatively, traces 70 can be in the form of a conductive ink or paint which is applied directly to the CRT surface. Each of the separate conductive traces 70 can be individually electrically coupled to ground potential, normally by coupling to the grounded aquadag coating on the CRT surface. Alternatively, conductive traces 70 can be coupled together by a common conductive band, functionally similar to connecting means 16 (shown in FIG. 6), and further coupled to ground by a single common conductive element, functionally similar to ground tab 24 (shown in FIG. 6). The physical characteristics of the individual conductive traces 70, such as width, thickness, trace spacing, and length, share substantially similar values to the values as described in relation to the conductive elements 14 and 20 of electrostatic shield 10. Although the traces as illustrated in FIG. 7 are of equal length and width, this is simply an illustration of one of the preferred embodiments of the present invention. Alternative trace configurations can be envisioned which would achieve substantially the same shielding effect.

Referring now to FIGS. 8*a* and 8*b*, the operation of the electrostatic shield 10 or method of shielding an electric field in accordance with the present invention is illustrated. In FIG. 8*a*, shown is a cross-sectional view of a CRT display monitor, and an associated portion of the electric field lines 55 generated by deflection yoke 50 and associated CRT circuitry. As is illustrated, a significant portion of electric field lines 55 emanate towards and through face 60 of CRT 40, in the direction of a monitor operator. The electric field lines generated in the direction opposite the face of the CRT terminate on the monitor chassis 45. Chassis 45 is normally constructed of metal, and effectively shields the electric field generated by the deflection yoke in this direction from the outside environment.

In FIG. 8*b*, shown is the CRT display monitor of FIG. 8*a* with the addition of an electrostatic shield 10 in accordance with the present invention. As is illustrated, electric field lines 55 generated in the direction opposite face 60 of CRT 40 terminate on the monitor chassis 45, in a manner similar to the unshielded monitor. However, a substantial reduction in the electric field lines generated toward and through the face of the CRT is achieved due to incorporation of shield 10 into the system. This reduction is a result of shield 10 existing at essentially ground potential due to electrical coupling with the grounded aquadag coating on the outer surface of the CRT (as described in detail above). By positioning shield 10 between deflection yoke 50 and face 60 of CRT 40, as shown in FIG. 8*b*, and grounding the shield, a substantial portion of the electric field lines 55 generated by the deflection yoke are effectively terminated at the shield, and cannot transmit through the face of the CRT. This significantly reduces the magnitude of the electric field encountered by a user. Additionally, because the electrostatic shield 10 is positioned non-intrusively around the electron beam generated by the CRT, the beam is unaffected, and there is no degradation of screen performance.

A significant advantage of the electrostatic shield in accordance with the present invention is its ability to be easily integrated into existing display systems. That is, existing monitors can be retrofitted with the electrostatic shield with a minimum investment of capital, time and effort. Additionally, because of the shield's initial planar configuration, the manufacturing process used to produce the shield is simple and inexpensive. Alternatively, the method by which shielding is provided by applying conductive traces directly to the surface of the CRT, though less amenable to retrofitting, is also simple and inexpensive to implement. Thus, an apparatus and a method are provided which significantly reduce the magnitude of the electric field countered by a display operator, with a minimum of expense and complexity in implementation, and without negatively affecting overall CRT display performance.

Although the present invention has been described in terms of specific embodiments, and with reference to FIGS. 1–8, it should be understood that this was by way of illustration only, and should not be taken as a limitation of the invention. It is contemplated that many changes and modifications may be made by one of ordinary skill in the art without departing from the true spirit and scope of the invention. For example, it is contemplated that other methods of grounding electrostatic shield 10 may be employed without affecting the overall performance of the shield. A specific example of this would be coupling ground tab 24 to chassis 45 of the display monitor, or to another ground potential source. Additionally, although symmetry suggests that each of the conductive members be substantially equivalent in dimensions and other characteristics, this is not a functional requirement of the preferred embodiment. Any configuration which maintains device function would be sufficient.

What is claimed is:

1. An electrostatic shield for reducing electrical field emissions from a cathode ray tube display (CRT), comprising:

a flexible, non-conductive, substantially annular support means having a sector dissociated therefrom, and having an inner perimeter which defines an aperture through said support means concentric with a central axis of said support means, and further having a first plurality of radial incisions extending from said outer perimeter to first predetermined position on said support means, and a second plurality of radial incisions extending from said inner perimeter to second predetermined positions on said support means;

a plurality of segregated conductive elements disposed on a first surface of said support means and extending radially outward from third predetermined positions on said support means to fourth predetermined positions on said support means; and, connecting means disposed on said first surface, for electrically coupling each of said conductive members to ground potential, said connecting means comprising a substantially annular strip of conductive material disposed between said inner perimeter and said outer perimeter and electrically contacting each said conductive element.

2. An electrostatic shield as described in claim 1 wherein said connecting means includes an elongated ground tab, disposed on said support means and extending from said annular strip a predetermined distance beyond said outer perimeter, for coupling said conductive elements to ground potential.

3. An electrostatic shield as described in claim 1 wherein said first predetermined positions are located between said outer perimeter and said annular conductive strip, and said second predetermined positions are located between said inner perimeter and said strip.

4. An electrostatic shield as described in claim 1 wherein said plurality of segregated conductive elements includes a first group of elements which extend from said conductive strip to said outer perimeter, and a second group of elements which extend from said inner perimeter to said conductive strip.

5. An electrostatic shield as described in claim 2 wherein said plurality of segregated conductive elements includes a first group of elements which extend from said conductive strip to said outer perimeter, and a second group of elements which extend from said inner perimeter to said conductive strip.

6. An electrostatic shield as described in claim 5 wherein said first predetermined positions are located between said outer perimeter and said annular conductive strip, and said second predetermined positions are located between said inner perimeter and said strip.

* * * * *